US007758383B1

(12) United States Patent
Chantrell et al.

(10) Patent No.: US 7,758,383 B1
(45) Date of Patent: Jul. 20, 2010

(54) CONNECTOR ASSEMBLIES, COMBINATIONS AND METHODS FOR USE WITH FOIL-SHIELDED TWISTED PAIR CABLES

(75) Inventors: Thomas J. Chantrell, Westerly, RI (US); Michael J. Moldoch, Griswold, CT (US); William H. Dietz, Branford, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 12/471,061

(22) Filed: May 22, 2009

Related U.S. Application Data

(63) Continuation-in-part of application No. 12/321,240, filed on Jan. 16, 2009.

(51) Int. Cl.
*H01R 9/03* (2006.01)

(52) U.S. Cl. ..... 439/607.41; 439/462

(58) Field of Classification Search ..... 439/462, 439/461, 701, 676, 314, 321, 607.41
See application file for complete search history.

(56) References Cited

U.S. PATENT DOCUMENTS 6,817,902 B2 * 11/2004 Bernardi et al. ..... 439/676
6,935,886 B2 * 8/2005 Hoch et al. ..... 439/462
6,948,971 B2 * 9/2005 Bartholoma et al. ..... 439/462
7,214,094 B2 * 5/2007 Kaminski et al. ..... 439/550
2005/0277335 A1 12/2005 Gordon et al.

FOREIGN PATENT DOCUMENTS

WO 2008/081087 7/2008

OTHER PUBLICATIONS

U.S. Appl. No. 12/321,240, filed Jan. 16, 2009.

* cited by examiner

*Primary Examiner*—Khiem Nguyen
(74) *Attorney, Agent, or Firm*—McCarter & English, LLP

(57) ABSTRACT

Connector assemblies, combinations and methods for use in wiring/cabling applications are disclosed. Connector assemblies include openings that facilitate interaction between plugs and cables, particularly foil-shielded twisted pair (FTP) cables. Connector assembly sub-components and connector sub-assemblies are also disclosed. Connector assemblies and sub-assemblies include securely coupled or joined sub-components. Sub-components are coupled to one another through the use of deflectable latching members of one sub-component engaging corresponding latching slots of another sub-component. Sub-components and sub-assemblies are also coupled to one another through the use of a cam nut engaged into a cam slot of another sub-component or sub-assembly. Connector assemblies, combinations and methods including a contact capable of engaging an FTP cable, drain wire and metal foil or sheath through the application of a cam nut interaction with a cam member are also disclosed.

50 Claims, 11 Drawing Sheets

CONNECTOR ASSEMBLIES, COMBINATIONS AND METHODS FOR USE WITH FOIL-SHIELDED TWISTED PAIR CABLES

CROSS-REFERENCE TO RELATED APPLICATIONS

The present application is a continuation-in-part application that claims priority benefit to a co-pending, commonly assigned U.S. non-provisional application entitled "Connector Assemblies, Combinations and Methods for Use with Foil-Shielded Twisted Pair Cables" which was filed on Jan. 16, 2009, and assigned Ser. No. 12/321,240. The entire contents of the foregoing non-provisional application are incorporated herein by reference.

BACKGROUND

1. Technical Field

The present disclosure is directed to connector assemblies, combinations and methods for use with wires and cables. The disclosure is further directed to connector assemblies, combinations and methods that include a sub-assembly and are adapted for use with foil-shielded twisted pair (FTP) cables.

2. Background Art

Twisted pair cabling is a form of wiring in which two conductors (wires/cables) are wound together for the purposes of canceling out electromagnetic interference (EMI), electromagnetic radiation from unshielded twisted pair (UTP) wires/cables, crosstalk between neighboring pairs of cable/wire, or radiofrequency interference (RFI). Twisting wires/cables decreases interference because the loop area between the wires is reduced. In balanced pair operation, two wires/cables typically carry equal and opposite signals which are combined by addition at the destination. The common-mode noise from the two wires/cables helps to cancel each other because the two wires have similar amounts of EMI that are 180 degrees out of phase.

In order to further reduce interference and other sources of signal deterioration, electrical wires/cables often further include an insulating jacket surrounding each individual wire, a metal foil or braided sheath surrounding twisted wire/cable pairs and a drain wire. Twisted pair wires/cables are often shielded in attempt to prevent electromagnetic interference, but, because the shielding is made of metal, shielding may also serve as a ground. However, a shielded or screened twisted pair wire/cable usually has a special grounding wire added called a drain wire. A drain wire directs extraneous signals to ground. Shielding can be applied to individual wire/cable pairs, or to a collection of pairs. When shielding is applied to the collection of all pairs of wires/cables present, the shielding is referred to as screening. Shielding must usually be grounded for the shielding to function properly. Cables which include at least one twisted wire/cable pair (in which the wires/cables may be individually insulated), a drain wire, a metal foil or sheath surrounding the twisted pair(s) and drain wire, and an insulating jacket surrounding the wires/cables and the metal foil or sheath are commonly referred to as foil-shielded twisted pair (FTP) cables.

An FTP cable may be terminated by a connector assembly, such as a jack, that is adapted to operatively engage a mating connector, such as a plug. A jack typically includes a housing, sometimes made from several individual parts, that is manufactured from non-conductive material(s). A jack assembly may include a metal wrap to provide similar interference prevention as the metal foil or sheath in an FTP cable. Stated differently, a metal wrap in a jack housing, or other similarly functioning mechanism, may serve as a continuation of the foil wrap or shielding of an FTP cable so that continuity of shielding is provided to and through the connection into the jack housing. In such shielded jacks, the drain wire of an FTP cable may be secured to the metal wrap. A mating shield plug may be engaged within a shielded jack, and the metal shield of the jack may contact the metal wrap of the jack, thereby providing electrical continuity.

An end user of a connector assembly (also known as a jack) is the installer. An end user typically connects an FTP cable to a corresponding jack manually—i.e., by physically exposing the wire/cable of the twisted pair(s), exposing the terminals located inside the jack housing if they are not already exposed, connecting the wires/cables to the terminals, and, finally, assembling the jack into its final form. The final form of a connector assembly commonly includes a covering or other protecting mechanism over the wire-terminal connections.

As an example, WO 2008/081087 discloses a socket to be mounted on a multi-conductor cable and includes a removable comb defining a central channel, a connection terminal block, and a screw and nut assembly. According to WO 2008/081087, the screw is fixedly mounted on the removable comb for axial translation and rotation relative the axis (X) of the socket. The terminal block includes two columns that prevent the rotation of the comb. The screw defines two helical slopes capable of engaging corresponding helical notches defined by the columns of the connection terminal block. As the screw is rotated, the helical slopes and helical notches interact and a torque is created. This torque causes translation between the screw and the terminal block, ultimately resulting in a secure connection between the screw, comb and terminal block.

It is important for an end user to securely connect the FTP wire/cable to the jack housing because a secure connection can prevent the FTP cable from pulling away from the housing and therefore cause the twisted pair wires from disconnecting or disengaging from the terminals located inside the jack housing. As discussed above, to ensure proper functionality it is important that an end user securely engages the subcomponents of a jack to one another, provides continuity of shielding to and through the connection into the jack housing, and provides a secure connection between the terminals of the jack and the individual FTP wires.

Despite efforts to date, a need remains for connector assemblies, combinations and methods that provide enhanced FTP cable-to-jack connections. A need also remains for connector assemblies, combinations and methods that provide for improved connector assembly construction wherein each sub-component of the connector assembly can be easily secured to one another by an end user. Yet another need remains for connector assemblies, combinations and methods that provide enhanced FTP wire-to-terminal connections and shielding. These and other needs are satisfied by the connector assemblies, combinations and methods disclosed herein.

SUMMARY

The present disclosure is directed to connector assemblies, combinations and methods. The disclosed connector assemblies, combinations and methods may have particular utility in FTP cables or wiring applications, but the disclosure is not limited to such applications and/or limitations. In exemplary embodiments, the disclosed connector assemblies and sub-assemblies facilitate interaction between a wire or cable interacting with the connector assembly (also known as a jack) or sub-assembly and the wire or cable interacting with a plug. Thus, in an exemplary embodiment, the disclosed connector assemblies define a first jack that is configured and dimensioned to electrically cooperate with a first plug. In another exemplary embodiment, the disclosed connector assemblies define a first jack that is configured and dimensioned to electrically cooperate with a first plug and an FTP cable including a drain wire.

The disclosed connector assemblies, systems, combinations and techniques support enhanced cable-to-jack connection. The assemblies, systems, combinations and techniques also support enhanced assembly of jack sub-components and use by an end user. Stated differently, the disclosed jack configuration and design provides for a jack containing securely connected sub-components, a secure, shielded jack-FTP cable/wire connection, and a jack that can be easily assembled and used by an end user.

The present disclosure provides for connector assemblies and sub-assemblies including securely joined sub-components. The sub-components which makeup the disclosed connector assemblies and sub-assemblies may be secured to one another through the use of deflectable latching members and corresponding latching slots. Also, such connector assemblies and sub-assemblies may include sub-components secured to one another through the use of a cam nut engaged into a cam slot of a cam member which extends from a sub-component and passes through several other sub-components. The disclosed connector assemblies, combinations and methods may also include a contact capable of engaging an FTP cable, drain wire and metal foil or sheath through the application and rotation of a cam nut with cam threads engaged in a cam slot of a cam member extending from one sub-component and passing through other sub-components. In fact, the disclosed exemplary embodiments may include a cam nut which serves to (1) interface with a front assembly and securely mate the front assembly to a rear assembly and complete FTP wire-to-terminal connection, and (2) deflect a contact to engage or interfere with a drain wire and/or shielding of an FTP cable.

The disclosed sub-components may include, for example, a jack housing, contact insert, printed circuit board (including plug connection elements and connection terminals), first sub-assembly housing, second sub-assembly housing, routing cap, cam nut and/or a deflectable contact.

Additional features, functions and benefits of the disclosed connectors, combinations and techniques will be apparent from the detailed description which follows, particularly when read in conjunction with the appended figures.

BRIEF DESCRIPTION OF FIGURES

To assist those of skill in the art in making and using the disclosed connectors, systems, combinations and techniques, reference is made to the accompanying figures, wherein.

DESCRIPTION OF EXEMPLARY EMBODIMENT(S)

Well-known functions or constructions may not be described in detail for brevity and clarity. As used herein, the term "drain wire" means an un-insulated wire in a cable that is in contact with a shield of the cable, such as a metal foil or sheath, throughout a major portion of its length. As used herein, the term "FTP wires" refers to the wires of at least one twisted pair of insulated or un-insulated wires in an FTP cable. As used herein, the term "FTP cable" refers to a cable that contains at least one twisted pair of insulated or un-insulated wires, a drain wire, a metal foil or sheath surrounding the twisted pair(s) and drain wire, and an insulating jacket surrounding the twisted pair(s) and the metal foil or sheath.

Figure 1:
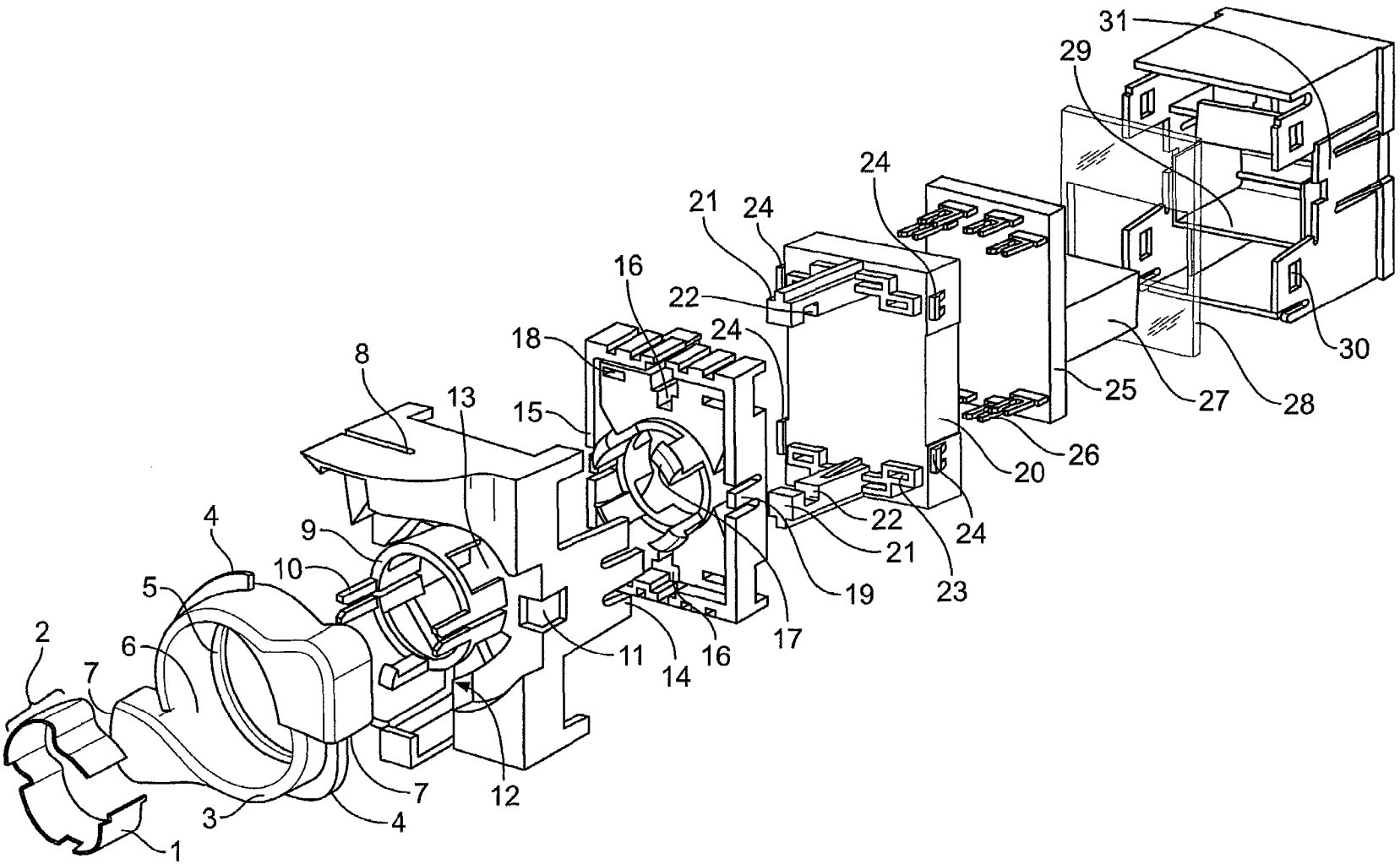
FIG. 1 is an exploded perspective view of an exemplary connector assembly according to the present disclosure.
Figure 2:
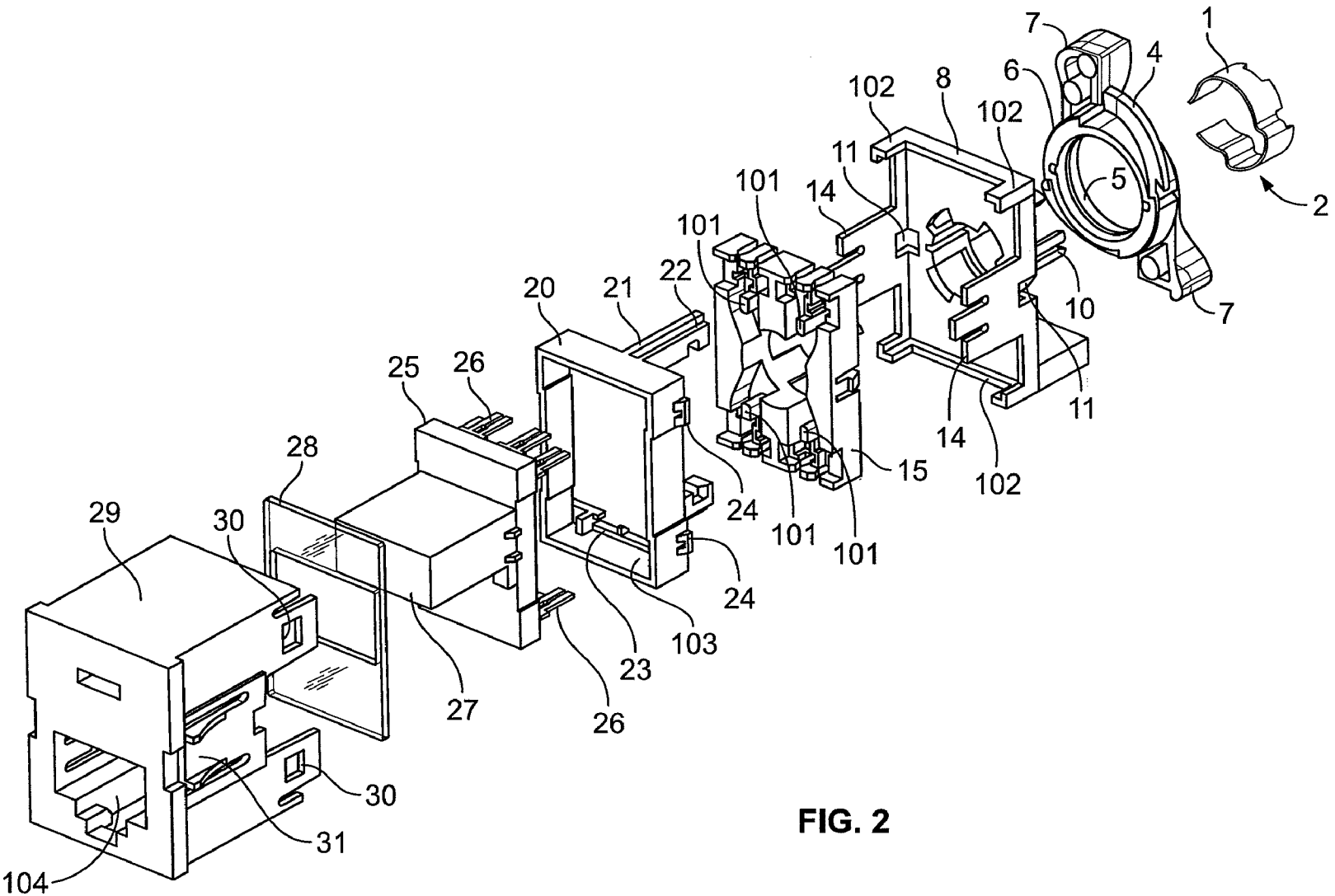
FIG. 2 is an exploded perspective view of the exemplary connector assembly of FIG. 1 viewed from the opposite direction as compared to the view of FIG. 1.

With reference to FIGS. 1 and 2, several exemplary connector assembly sub-components are disclosed. The disclosed exemplary sub-components are strictly exemplary and may be altered without departing from the spirit and scope of the present disclosure. Such alternative connector assembly sub-component embodiments are contemplated. Also, although the described assemblies and figures describe or depict several exemplary combinations of the sub-components, such sub-components may be combined through the use of alternative methods or designs, or may include additional sub-components, a lesser amount of sub-components or rearranged sub-components, without departing from the spirit and scope of the present disclosure. Such alternative connector assembly embodiments are hereby contemplated.

Turning to FIG. 1, an exemplary connector assembly, in an exploded view, is shown. The exemplary connector assembly in FIG. 1 contains several exemplary sub-components. One such sub-component is exemplary cylindrical contact 1. Exemplary cylindrical contact 1 follows a general elliptical or circular shape and may be made from a conductive material. Exemplary cylindrical contact 1 is not contiguous, i.e., the cylindrical contact contains a gap. Such a gap in exemplary cylindrical contact 1 may allow exemplary cylindrical contact 1 to be "opened" or "closed," i.e., the circular or elliptical shape of cylindrical contact 1 may be made larger or smaller, respectively. The ability of cylindrical contact 1 to be "opened" or "closed" may allow cylindrical contact 1 to be adjusted to tightly or securely hold/contact an FTP cable or wires, drain wire, metal foil or sheath, and combinations thereof. Exemplary cylindrical contact 1 may also include an exemplary collar 2. Exemplary collar 2 is an area of cylindrical contact 1 that does not follow the generally elliptical or circular shape of cylindrical contact 1. Exemplary collar 2 may depart from the elliptical or circular profile of exemplary cylindrical contact 1 by defining a similar but larger elliptical or circular profile. Such exemplary collar 2 may allow a material to be passed through exemplary cylindrical contact 1 which does not follow the elliptical or circular inner area defined by exemplary cylindrical contact 1. As such, exemplary cylindrical contact 1 and collar 2 may allow an FTP cable to pass through exemplary cylindrical contact 1 while simultaneously allowing the FTP cable's drain wire or metal foil or sheath which has passed through exemplary cylindrical contact 1 to be re-diverted back through exemplary cylindrical contact 1 (through exemplary collar 2) and come into direct contact with exemplary cylindrical contact 1. Stated differently, exemplary collar 2 may allow a drain wire or metal foil/sheath and an FTP cable to pass through exemplary cylindrical contact 1. The edges of exemplary cylindrical contact 1 may define a particular pattern, e.g., an edge or edges of exemplary cylindrical contact 1 may not be straight or flat. The profile of exemplary cylindrical contact 1 may also include at least one bend or otherwise depart from the general elliptical or circular shape. The profile of exemplary cylindrical contact 1 may assist or allow exemplary cylindrical contact 1 to be held or otherwise joined to a connector assembly sub-component and/or sub-assembly.

Cylindrical contact 1 may be shaped and designed so as to allow deflection or bias, thereby being capable of engaging an FTP cable/wires, drain wire and metal foil or sheath. Such deflection may be achieved by the deflection of deflectable fingers or latching members engaging cylindrical contact 1. For example, cylindrical contact 1 may be deflectable by an inner diameter feature of a cam nut which interacts with deflectable fingers or latching members engaging cylindrical contact 1.

One such disclosed exemplary sub-component which may be capable of holding, connecting to, or otherwise being joined to an exemplary cylindrical contact is exemplary first sub-assembly housing 8. The exemplary embodiment of first sub-assembly housing 8 may include a cylindrical member 9 extending from a first face. Cylindrical member 9 may include fingers or deflectable latching members 10. The fingers or deflectable latching members 10 of an exemplary cylindrical member may correspond to the surface and/or edge profile of an exemplary cylindrical contact and thereby allow the cylindrical member and cylindrical contact to be coupled. Exemplary fingers or deflectable latching members 10 may also be flexible and may therefore transfer "opening" or "closing" forces to an exemplary cylindrical contact engaged thereto. Stated differently, deflection of exemplary fingers or deflectable latching members 10 may bias cylindrical contact 1 and, as a result, cylindrical contact 1 may interfere or contact a drain wire, metal foil sheath, an FTP cable/wires or combinations thereof. Further, exemplary first sub-assembly housing 8 and fingers or deflectable latching members 10 may be shaped and/or designed to allow deflection of fingers or deflectable latching members 10 (resulting in deflection of cylindrical contact 1) through interaction of a sub-component and/or sub-assembly. For example, exemplary first sub-assembly housing 8 and/or fingers or deflectable latching members 10 may be shaped and designed to allow deflection of deflectable latching members 10 and/or contact 1 by the interaction of a cam nut thereto.

Cylindrical member 9 may define an opening though exemplary first sub-assembly housing 8. Such opening may facilitate an FTP cable or FTP wires to pass through first sub-assembly housing 8. Cylindrical member 9 may also define a latching slot 13. Latching slot 13 may be engaged by another component, such as a deflectable latching member to facilitate a secure connection between the first sub-assembly housing and another component. Exemplary first sub-assembly housing 8 may also include at least one deflectable latching member 14. Such deflectable latching member 14 can engage latching slots formed in another cooperative connector assembly component. Additional latching structures (not shown) may be provided on exemplary first sub-assembly housing 8, e.g., along the bottom or top surfaces thereof, to further facilitate a secure connection to another component. Exemplary first sub-assembly housing 8 may also include at least one latching slot 11. Such latching slot 11 may be engaged by another component, such as a deflectable latching member. Additional latching slots (not shown) may be provided on exemplary first sub-assembly housing 8, e.g., along the bottom or top surfaces thereof, to further facilitate a secure connection to another component. As shown in FIG. 2, exemplary first sub-assembly housing 8 may be further designed to accept the attachment of a connector sub-component by defining a frame, housing or ledge(s) 102 for the sub-component on a second face (opposite of the face containing the cylindrical member).

An exemplary cylindrical member extending from a first face of an exemplary first sub-assembly housing may also be designed to allow for a cam nut to be positioned thereon. As shown in FIG. 1, exemplary cam nut 3 has an inner opening 6 that corresponds to the cylindrical member onto which cam nut 3 is positioned. The inner diameter may be sized and dimensioned for interaction with a cylindrical member and allow an FTP cable or FTP wires to pass through the cam nut 3 or a cylindrical member. Exemplary cam nut 3 may also include an inner diameter feature 5. Inner diameter feature 5 may allow cam nut 3 to deflect the cylindrical member, fingers or deflectable latching members 10 located thereon, and a cylindrical contact 1 if attached to the fingers or deflectable latching members. This functionality may be achieved, for example, if the outer diameter defined by the cylindrical member varies and, at some location, is larger than the inner diameter feature of the cam nut 3. In this exemplary scenario, when the cam nut 3 is positioned over the larger diameter area, the cam nut 3 would depress the fingers or deflectable latching members 10 and a cylindrical contact 1 located thereon.

As shown in FIGS. 1 and 2, an exemplary sub-component that may attach or otherwise mate with a first sub-assembly housing is exemplary routing cap 15. Turning to FIG. 1, exemplary routing cap 15 may include a deflectable latching member 19. Deflectable latching member 19 may engage a latching slot in another component—thereby facilitating a secure connection between the exemplary routing cap 15 and another component. For example, routing cap 15 may be joined, coupled or otherwise connected to first sub-assembly housing 8 with the latching member 19 that corresponds to latching slot 11. Exemplary routing cap 15 may also include a fingers or deflectable latching members 17 extending from a first surface. The fingers or deflectable latching members 17 of the exemplary routing cap may form a ring and correspond to latching slots in a cylindrical member of an exemplary sub-component—thereby allow the routing cap and corresponding sub-component or sub-assembly to be coupled to one another. For example, routing cap 15 may be joined to first sub-assembly housing 8 by the latching members 17 that correspond to latching slots 13. The fingers or deflectable latching members 17 may also define an opening though exemplary routing cap 15. Such opening may facilitate an FTP cable and/or FTP wires to pass through exemplary routing cap 15. Further, routing cap 15 may include terminal slots 18 that allow terminals 26, which may protrude from PCB 25, to pass through, at least in part, routing cap 15. Turning to FIG. 2, exemplary routing cap 15 may include wire routing channels 101 on a second surface (opposite of the face containing the ring of fingers or deflectable latching members). Such exemplary routing channels 101 may facilitate the guidance of FTP wires to pre-determined positions—such as to wire terminals located in such channels. Exemplary routing channels 101 may also prevent shorting of FTP wires and/or assist in interference prevention/shielding.

The present disclosure also provides an exemplary jack housing 29. As shown in FIG. 2, exemplary jack housing 29 defines a first plug/jack opening 104 on a face thereof. An exemplary label slot is also defined adjacent to jack opening 104. The exemplary label slot permits an end user to label the electrical connection associated with the connector assembly for future reference. Alternative labeling techniques may be employed, as are known in the art.

As shown in FIG. 1, exemplary jack housing 29 also defines a rear opening and boundary that may be further divided and/or include members or other structures therein. Exemplary jack housing 29 may include a deflectable latching member 31. Deflectable latching member 31 may engage a latching slot or member in another component—thereby facilitating a connection between the exemplary jack housing 29 and the other component. For example, exemplary jack housing 29 may be joined to first sub-assembly housing 8 by the latching member 31 which correspond to latching member 14. Exemplary jack housing 29 may also define at least one latching slot 30. Latching slot 30 may be engaged by another component, such as a deflectable latching member, to facilitate a secure connection between the first sub-assembly housing and another component. As an example, exemplary jack housing 29 may be joined to second sub-assembly housing 20 by latching members 24 which to latching slots 30.

A contact insert 28 may extend into the rear opening formed in exemplary jack housing 29 and defines, in part, a boundary of the jack opening formed in second exemplary jack housing 29. A printed circuit board (PCB) 25 may also be positioned into the rear opening formed in exemplary jack housing 29 and abut contact insert 28. Exemplary PCB 25 may include conventional electronic elements/components, e.g., traces printed or etched on a non-conductive substrate that facilitate electrical connection across the connector assembly. Exemplary PCB 25 may also include conventional plug connections elements 27. Such conventional plug connection elements 27 may be designed to electrically cooperate with and engage a plug inserted into plug/jack opening 104 and may continue such electrical connection to exemplary PCB 25.

The electrical connection and signal carried from an inserted plug may terminate on exemplary PCB 25 with terminals 26. Exemplary terminals 26 may be made from electrically conductive material and designed to accept connection of FTP wires. Exemplary terminals 26 may be "U" or "V" shaped to thereby allow an FTP wire to be pressed into each exemplary terminal and be securely joined or held by the exemplary terminal. In another exemplary design, exemplary terminals 26 may include a channel and opening, wherein the channel is less wide than the diameter of an FTP wire but the opening is slightly wider than the channel.

Exemplary PCB 25 and its components may be secured or coupled to exemplary jack housing 29 by another component which abuts the surface of PCB 25 and is coupled to exemplary jack housing 29. As an example shown in FIG. 2, exemplary jack housing 29 may be joined to second sub-assembly housing 20 by the latching members 24 which correspond to latching slots 30. When such connection is made, contact insert 28 and PCB 25 (including plug connection elements 27 and, at least in part, terminals 26) are securely held and contained in jack housing 29. Such connection may be further facilitated by the design of second sub-assembly housing 20. Exemplary second sub-assembly housing 20 may contain frames or ledges 103 that define a compartment in which PCB 25 can be securely housed. Further, exemplary second sub-assembly housing 20 may include terminal slots 23 that allow terminals 26, which may protrude from PCB 25, to pass through second sub-assembly housing 20 and allow the surface of PCB 20 to abut a face of second sub-assembly housing 20.

Exemplary second sub-assembly housing 20 is another exemplary connector assembly sub-component. As discussed above, exemplary second sub-assembly housing 20 may securely hold contact insert 28 and PCB 25 (including plug connection elements 27 and, at least in part, terminals 26) to the jack housing 29 by latching members 24. In one exemplary embodiment, exemplary second sub-assembly housing 20 may include at least one cam member 21. Cam member(s) 21 is/are element(s) that extend from a face of second sub-assembly housing 20. The exemplary cam member(s) 21 extend from a face opposite the side of second sub-assembly housing 20 that faces exemplary jack housing 29. As such, cam member(s) 21 extend away from exemplary jack housing 29. Cam member(s) 21 may be sized, shaped and dimensioned so that they may pass through several other sub-components. Cam member(s) 21 may also include a cam slot 22 which encompasses a slot located near the end of cam member(s) 21. Cam slot 22 may be a straight, curved or angled slot. In one exemplary embodiment, the cam slot(s) 22 extends generally perpendicular across the surface of the cam member 21 that faces the aperture defined thereby, in respect to the direction in which the cam member 21 extends from the face of the exemplary second sub-assembly housing 20.

In order for a cam member 21 of second sub-assembly housing 20 to extend or pass through another sub-component, the other sub-component may define a hole/aperture therein which mimics or resembles the shape of cam member 21. For example, as shown in FIG. 1, cam member(s) 21 of second sub-assembly housing 20 can pass through routing cap 15 via cam member gaps 16 and first sub-assembly housing 8 via cam member gaps 12 (the top cam member gap 12 cannot be seen due to the angle of view). When cam members 21 have passed through routing cap 15 and first sub-assembly housing 8, cam slots 22 may be located a certain distance past the surface of first sub-assembly housing 8. With reference to this state (the cam members passing through sub-components and the cam slots being exposed), cam thread(s) 4 located on the outer surface of cam nut 3 may interface with cam member(s) 21 by engaging cam slot(s) 22.

As discussed above, exemplary cam nut 3 may include exemplary cam threads 4 formed on the outside surface around at least a portion of exemplary cam nut 3. Each exemplary cam thread 4 may define a ridge extending from the surface of exemplary cam nut 3 and may be oriented on an angle or curve—similar to the threads of a common screw. Exemplary cam nut 3 may also include one or more cam stop members 7 which extend from the outer surface of exemplary cam nut 3 and define the borders or ends of cam threads 4. The one or more cam stop members 7 may be positioned farthest from the face of first sub-assembly housing 8 when positioned on cylindrical member 9 of first sub-assembly housing 8. When exemplary cam nut 3 is positioned on cylindrical member 9 and cam threads 4 engage cam slots 22, cam nut 3 may be rotated and, because of the angle of cam threads 4, torque will be created and cam nut 3 will pull together and secure second sub-assembly housing 20, routing cap 15 and first sub-assembly housing 8. Also, because jack housing 29, contact insert 28 and PCB 25 may be connected to second sub-assembly housing 20, the rotation of cam nut 3 may secure these sub-components to routing cap 15, first sub-assembly housing 8 and cylindrical contact 1—thereby forming a fully constructed connector assembly. Cam stop members 7 may prevent cam nut 3 from over-rotating cam threads 4.

As exemplary cam nut 3 is rotated, cam nut 3 may be translated towards, and finally come in contact with, the surface of first sub-assembly housing 8. As cam nut 3 shifts positions on cylindrical member 9, cam nut 3 may deflect or compress fingers or deflectable latching members 10 and, thereby, compress or deflect cylindrical contact 1. The deflection of fingers or deflectable latching members 10 may result from the shape and/or design of exemplary fingers or deflectable latching members 10, first sub-assembly housing 8, cylindrical member 9, the inner diameter of cam nut 3 or a combination thereof. In such an embodiment, an FTP cable may have previously been fed through cylindrical contact 1, first sub-assembly housing 8 and into routing cap 15. Also, FTP wires from the FTP cable may have been engaged through the routing channels 101 and into terminals 26. In addition, the drain wire and metal foil or sheath may have been re-directed back through cylindrical contact 1—passing over the FTP cable and through contact 1 by means of the collar 2. As such, rotation of cam nut 3 may jointly (1) engage connector sub-components, and (2) compress cylindrical contact 1, possibly onto an FTP cable, drain wire or metal foil or sheath. In such an embodiment, cylindrical contact 1 may provide continuity and shielding of the FTP wires to the connector assembly entrance. Stated differently, rotation of cam nut 3 may simultaneously result in (1) secure assembly of jack sub-components and/or sub-assemblies, and (2) interference or contact between a contact and a FTP cable, FTP wires, drain wire or shielding.

As may be recognized by those of ordinary skill in the pertinent art based on the teachings herein, the contact which is biased into the FTP cable, drain wire or shielding may take any of numerous different shapes or configurations that are currently known, or that later become known. For example, rather than a cylindrical contact, a lever type contact may be coupled to the connector assembly and biased or urged into contact with the FTP cable, drain wire or shielding by rotation and/or translation of the cam nut. The lever type contact may, for example, be an elongate, substantially linear contact with a curvilinear profile or an elongate "L" shaped contact. As another example, rather than the contact being coupled to the jack on deflectable members extending from a face of a component of the connector assembly, at least one end of a contact, such as one of the two alternative contact embodiments discussed above, may be coupled to another portion of the connector assembly component which may or may not be deflectable or biased by rotation or translation of the cam nut. In such an exemplary embodiment, the contact itself may be deflectable and/or shaped, dimensioned or positioned such that rotation or translation of the cam nut biases the contact into the FTP cable, drain wire or shielding. For example, an elongate, non-cylindrical deflectable contact may define at least one end coupled to the connector assembly component and a free end distally spaced relative to the component which is biased into contact with the FTP cable, drain wire or shielding by rotation or translation of the cam nut.

Figure 3A:
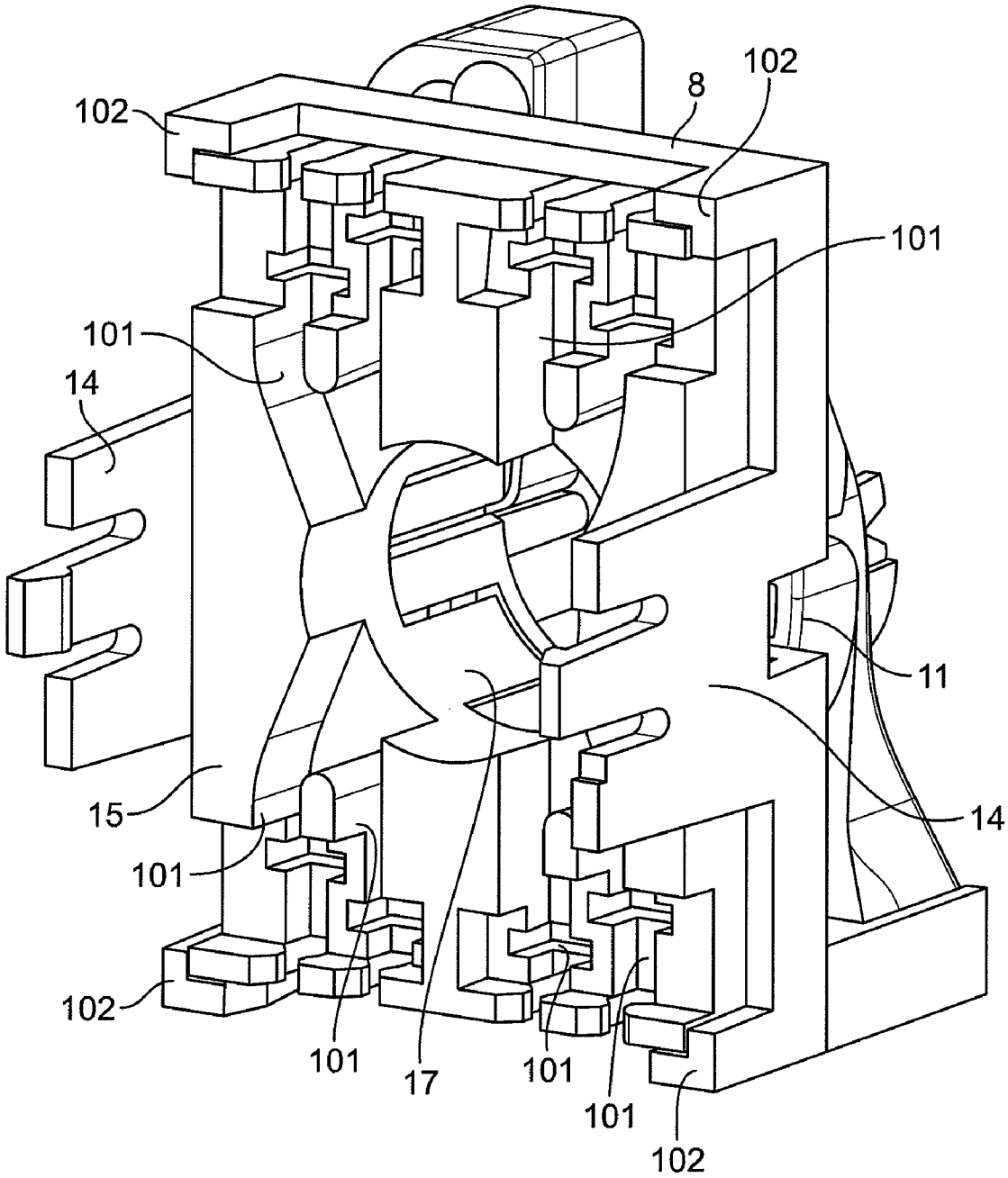
FIG. 3A is a perspective view of an exemplary first connector sub-assembly according to the present disclosure.
Figure 3B:
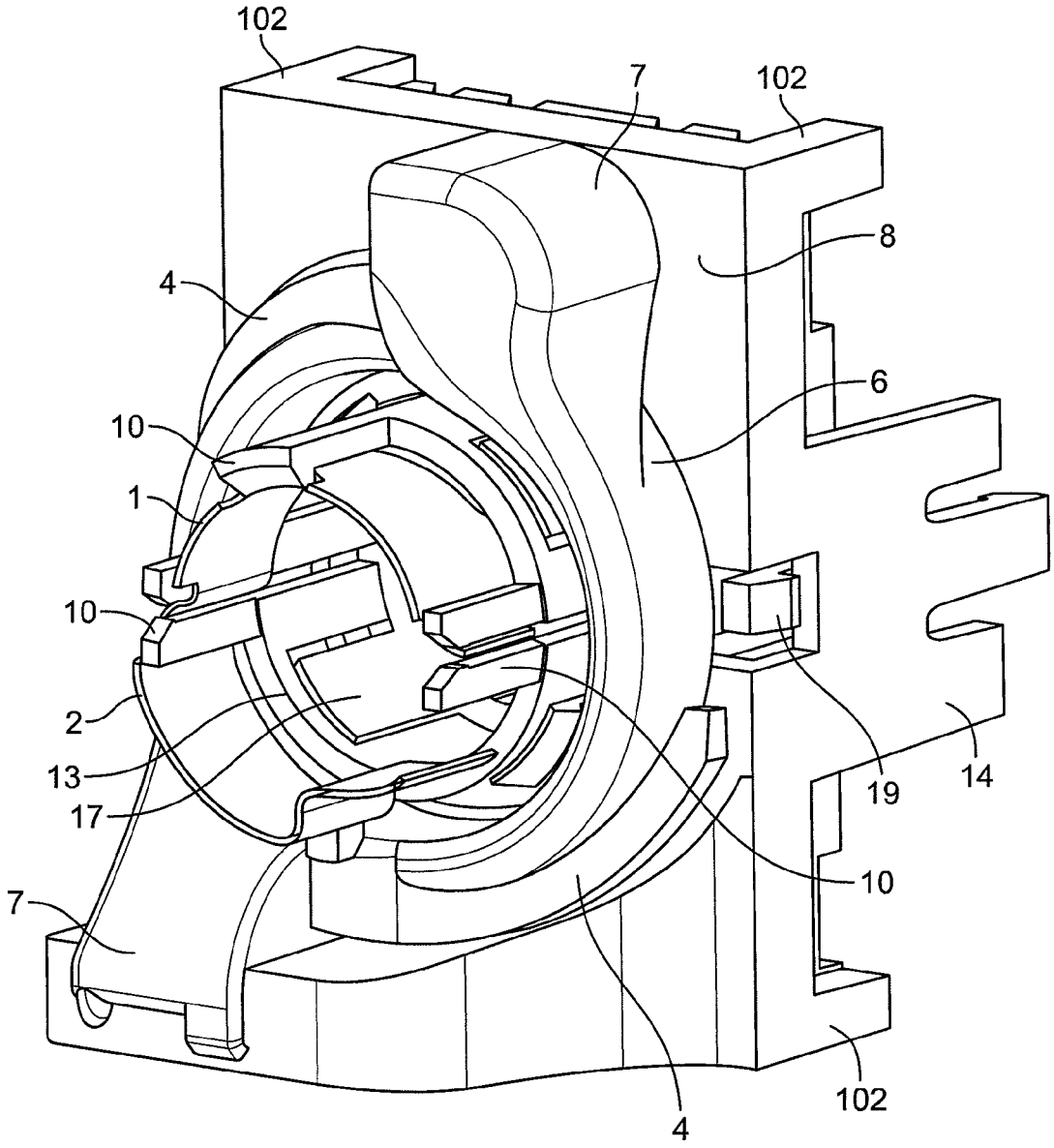
FIG. 3B is a perspective view of the exemplary first connector sub-assembly of FIG. 3A viewed from the opposite direction as compared to the view of FIG. 3A.

As discussed above, several of the disclosed connector sub-components can by coupled or joined to one another, such as through the use deflectable latching members and corresponding latching slots. FIGS. 3A and 3B depict an exemplary first connector sub-assembly. The disclosed sub-assembly includes an entrance for an FTP cable and/or FTP wires. The exemplary first connector sub-assembly includes routing cap 15, first sub-assembly housing 8, cam nut 3 and cylindrical contact 1. Routing cap 15 may be secured to first sub-assembly housing 8 by the interaction of deflectable latching members 19 and latching slots 11. Frame, housing or ledges 102 may also assist in securing routing cap 15 to first sub-assembly housing 8. Still further, routing cap 15 and first sub-assembly housing 8 may be joined by the interaction of fingers or deflectable latching members 17 and latching slots 13.

Figure 4A:
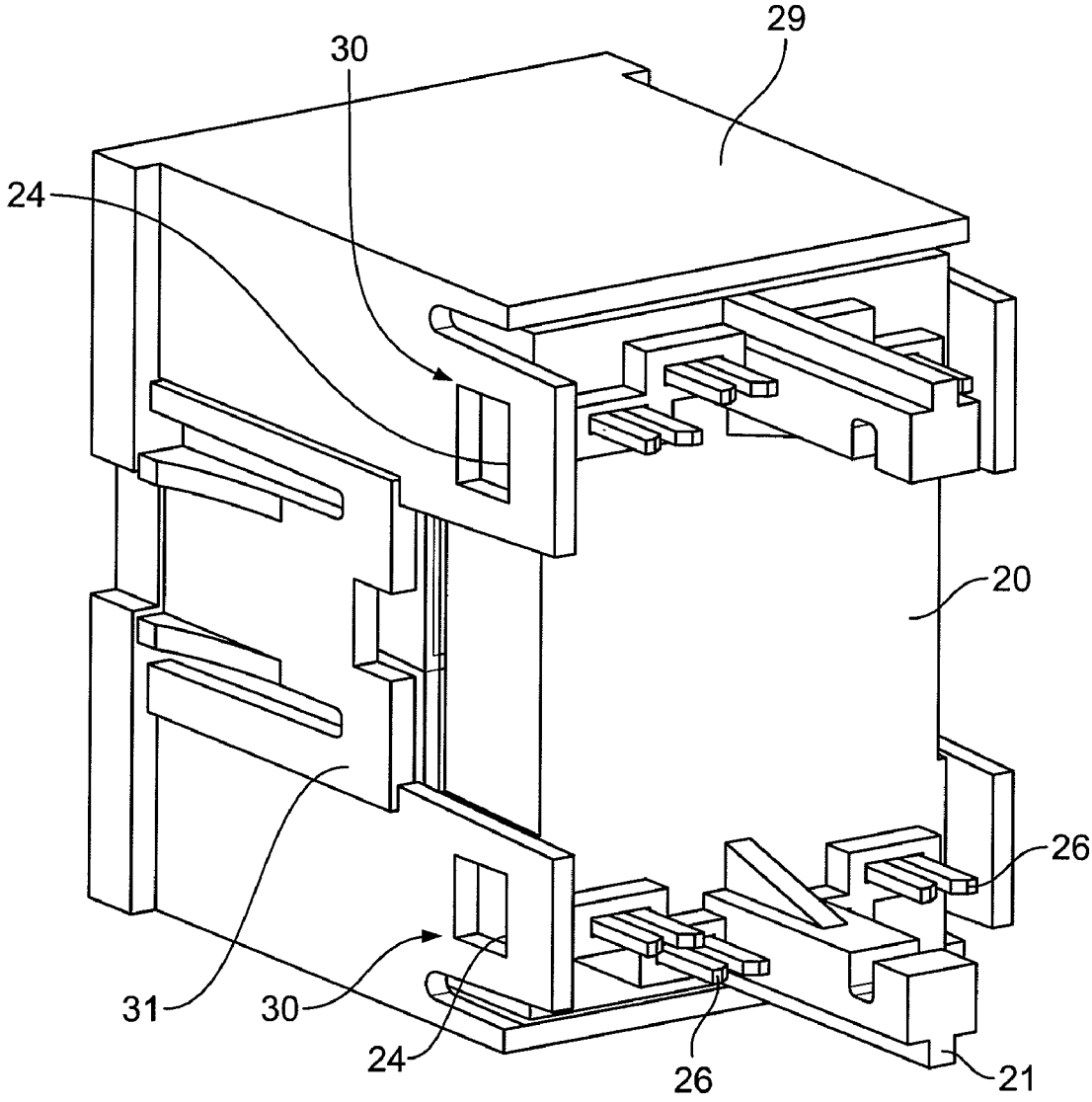
FIG. 4A is a perspective view of an exemplary second connector sub-assembly according to the present disclosure.
Figure 4B:
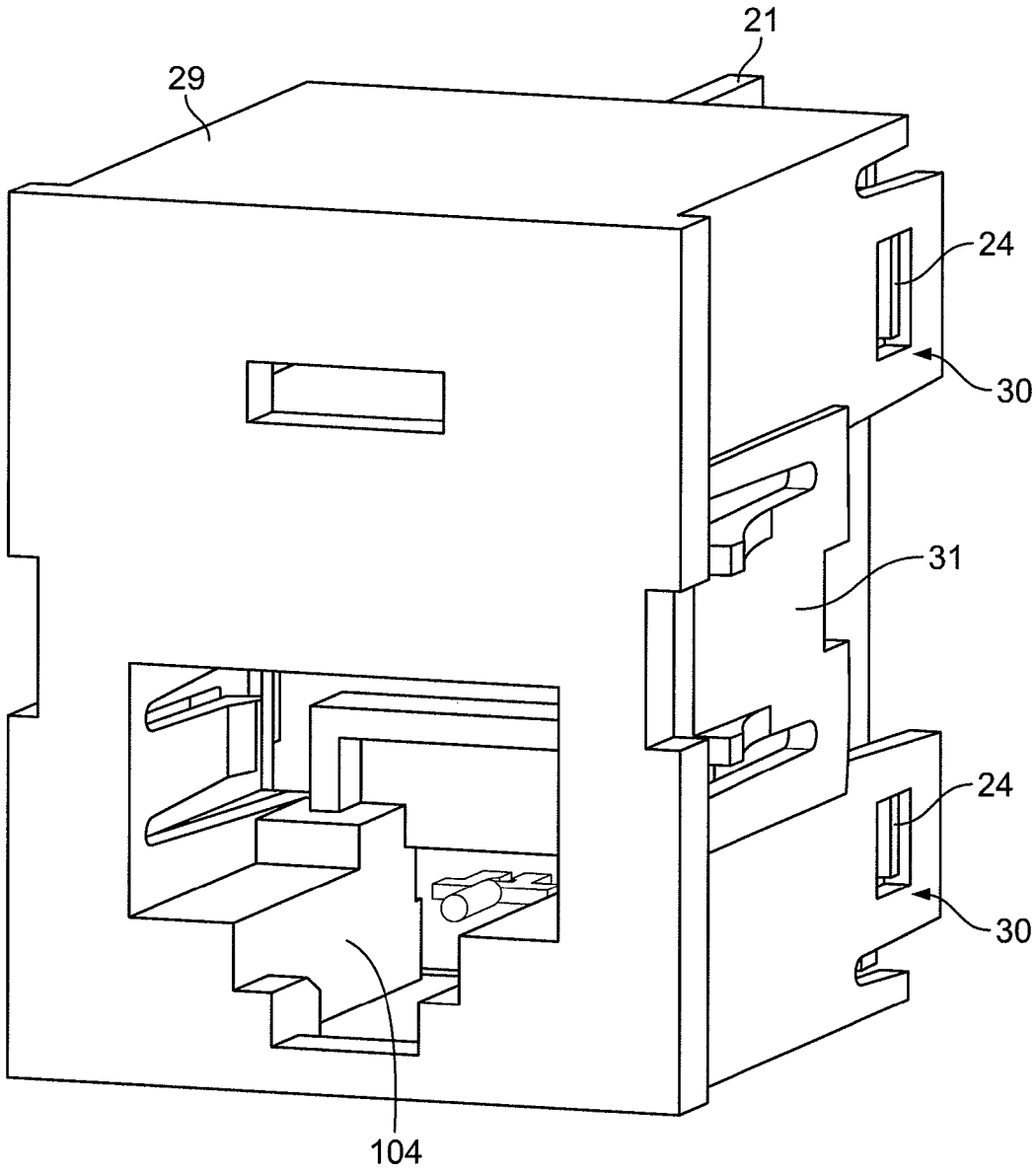
FIG. 4B is a perspective view of the exemplary second connector sub-assembly of FIG. 4A viewed from the opposite direction as compared to the view of FIG. 4A.

FIGS. 4A and 4B depict an exemplary second connector sub-assembly. The disclosed sub-assembly includes a jack housing 29 with an entrance for an electrical plug 104, a second sub-assembly housing 20, contact insert 28 and PCB 25 (including plug connection elements 27 and terminals 26). The second sub-assembly housing 20 and jack housing 29 are coupled or joined by the interaction of deflectable latching members 24 and latching slots 30. Contact insert 28 and PCB 25 (including plug connection elements 27 and terminals 26) are secured in the second sub-assembly by being encased or housed inside the area defined by the jack housing 29 and second sub assembly housing 20.

Figure 5A:
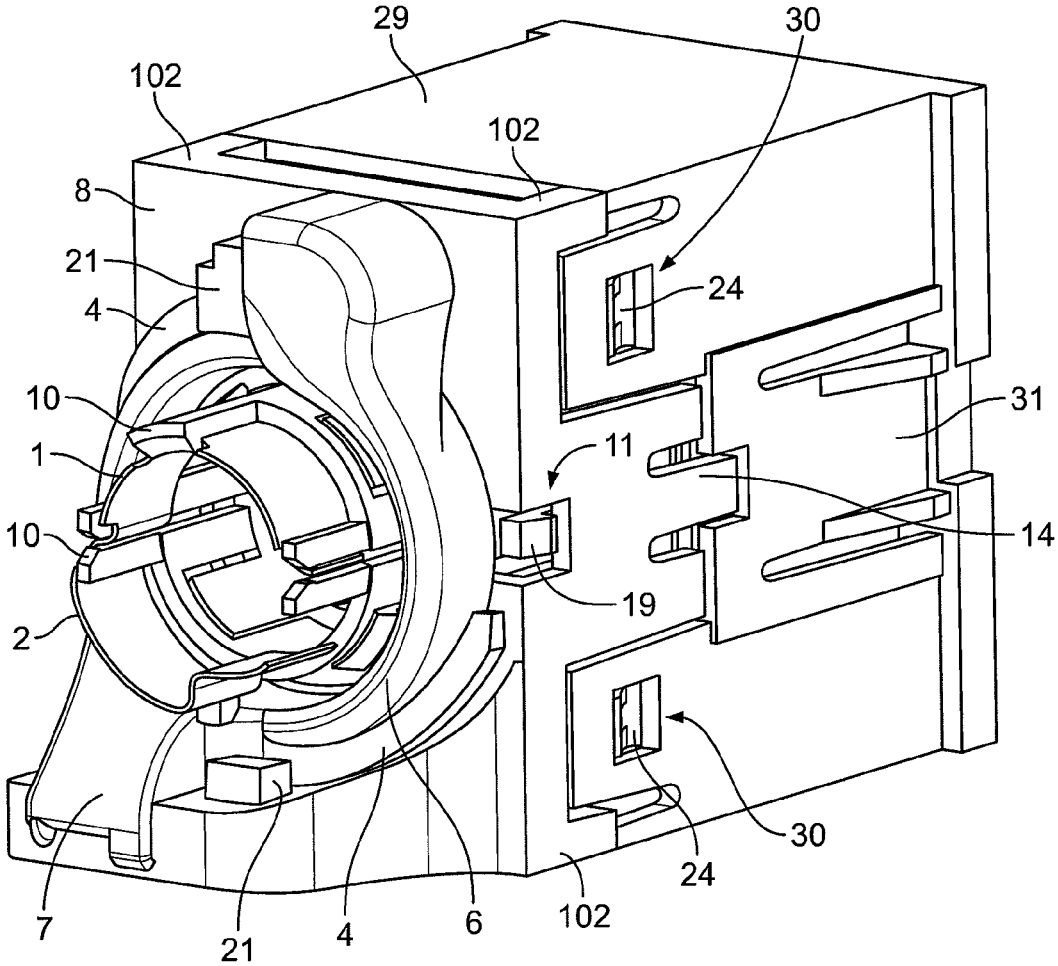
FIG. 5A is a perspective view of an exemplary connector assembly formed by the interaction of the exemplary first connector sub-assembly of FIGS. 3A and 3B and the exemplary second connector sub-assembly of FIGS. 4A and 4B.
Figure 5B:
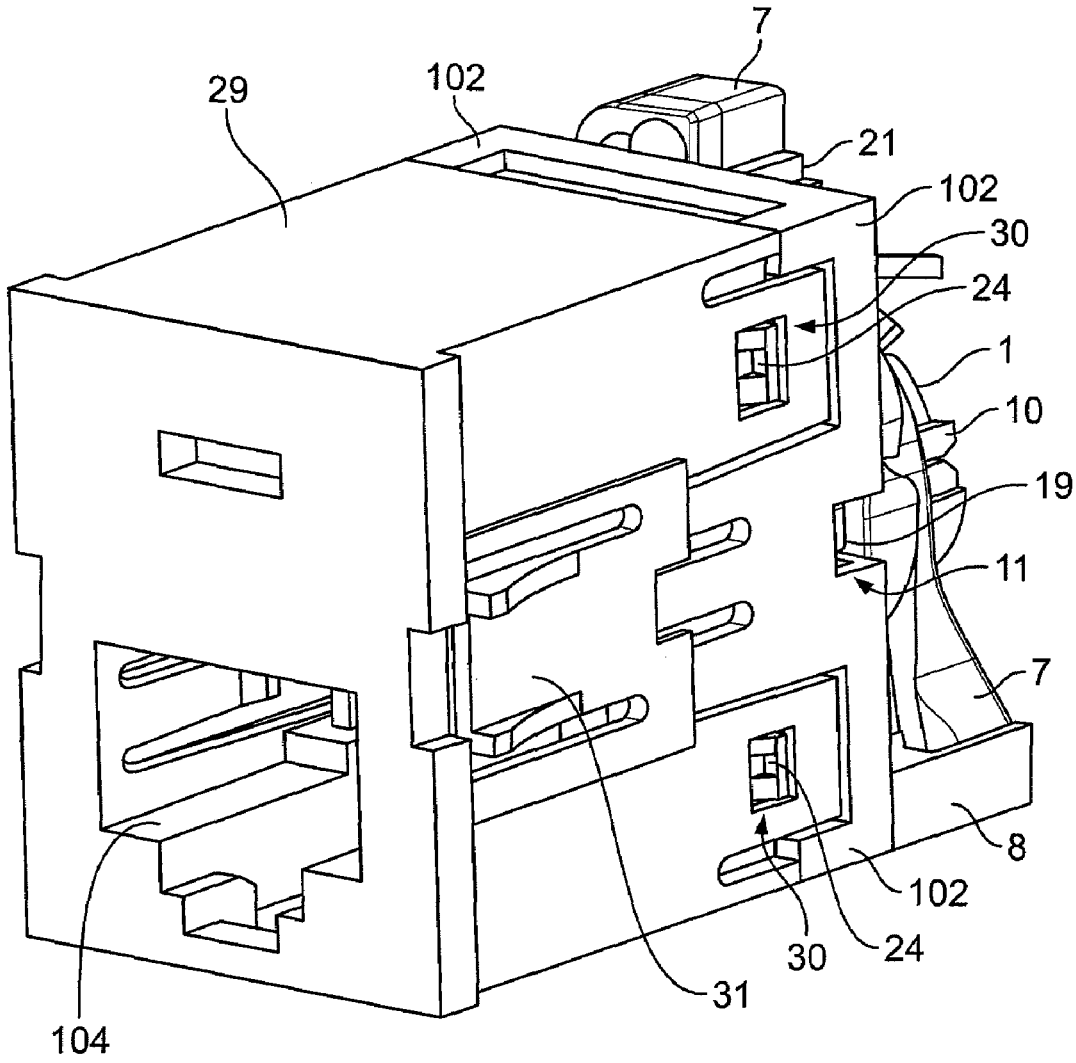
FIG. 5B is a perspective view of the exemplary connector assembly of FIG. 5A viewed from the opposite direction as compared to view of FIG. 5A.

As discussed above and as shown in FIGS. 5A and 5B, exemplary first connector sub-assembly and exemplary second connector sub-assembly can be joined to form a constructed connector assembly. The first connector sub-assembly and second connector sub-assembly may be coupled or joined by the interaction of deflectable latching members 14 and 31. The first connector sub-assembly and second connector sub-assembly may also be coupled and/or joined by the interaction and rotation of cam threads 4 on cam nut 3 and the cam slot 22 of cam member 21. If an FTP cable was fed through cylindrical contact 1 and the drain wire and metal foil or sheath of the FTP cable was redirected through the FTP cable and collar 2, the interaction and rotation of cam threads 4 on cam nut 3 and the cam slot 22 of cam member 21 would deflect the cylindrical contact 1 to interfere with the drain wire and metal foil or sheath. FTP cable/wire may also be fed through the opening in the first sub-assembly housing 8 and routing cap 15 (not shown—see FIG. 1), along routing channels 101 (not shown—see FIG. 2) and engaged with terminals 26 before the first and second sub-components are coupled/joined to form a fully constructed connector assembly.

Figure 6A:
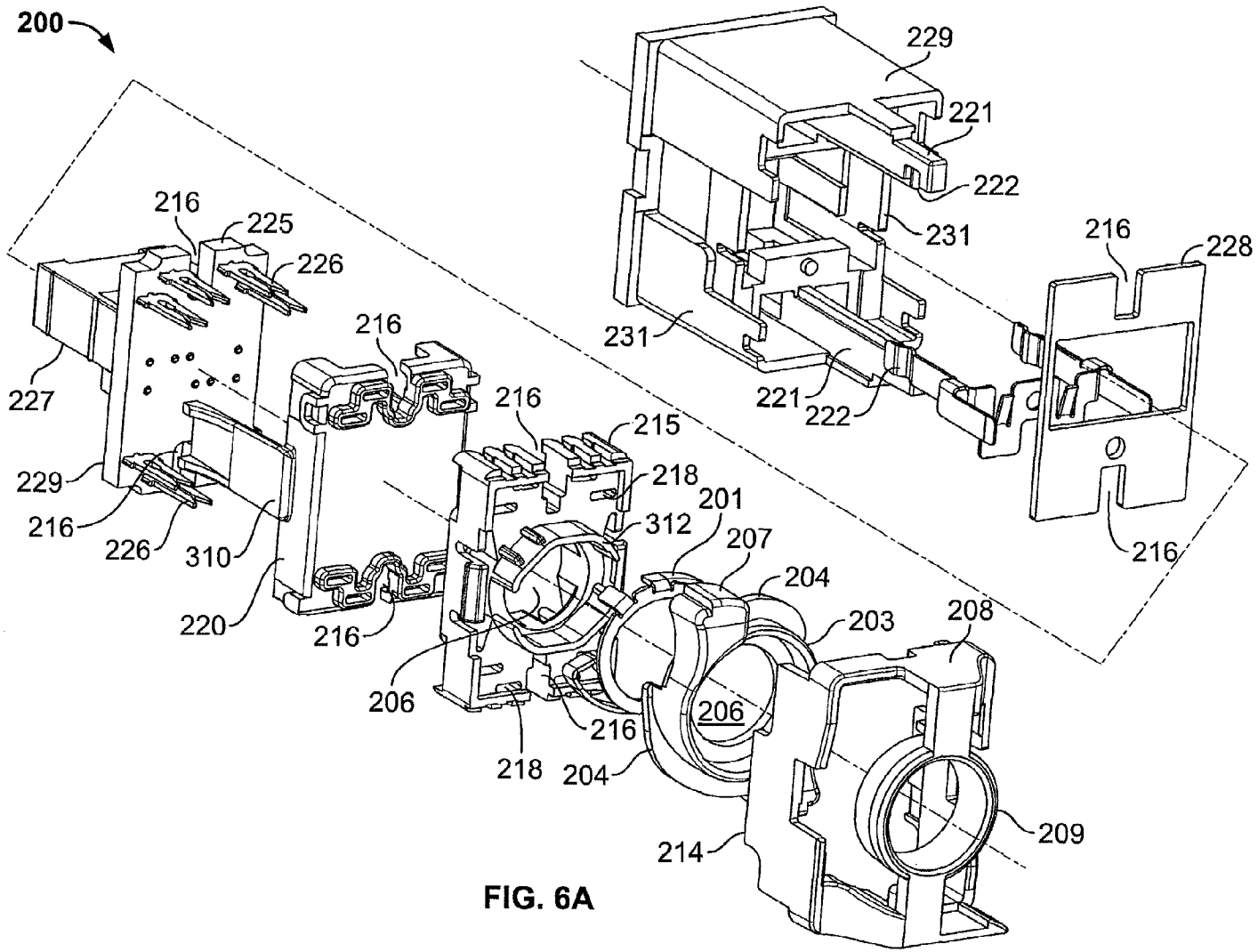
FIG. 6A is an exploded perspective view of another exemplary connector assembly according to the present disclosure.
Figure 6B:
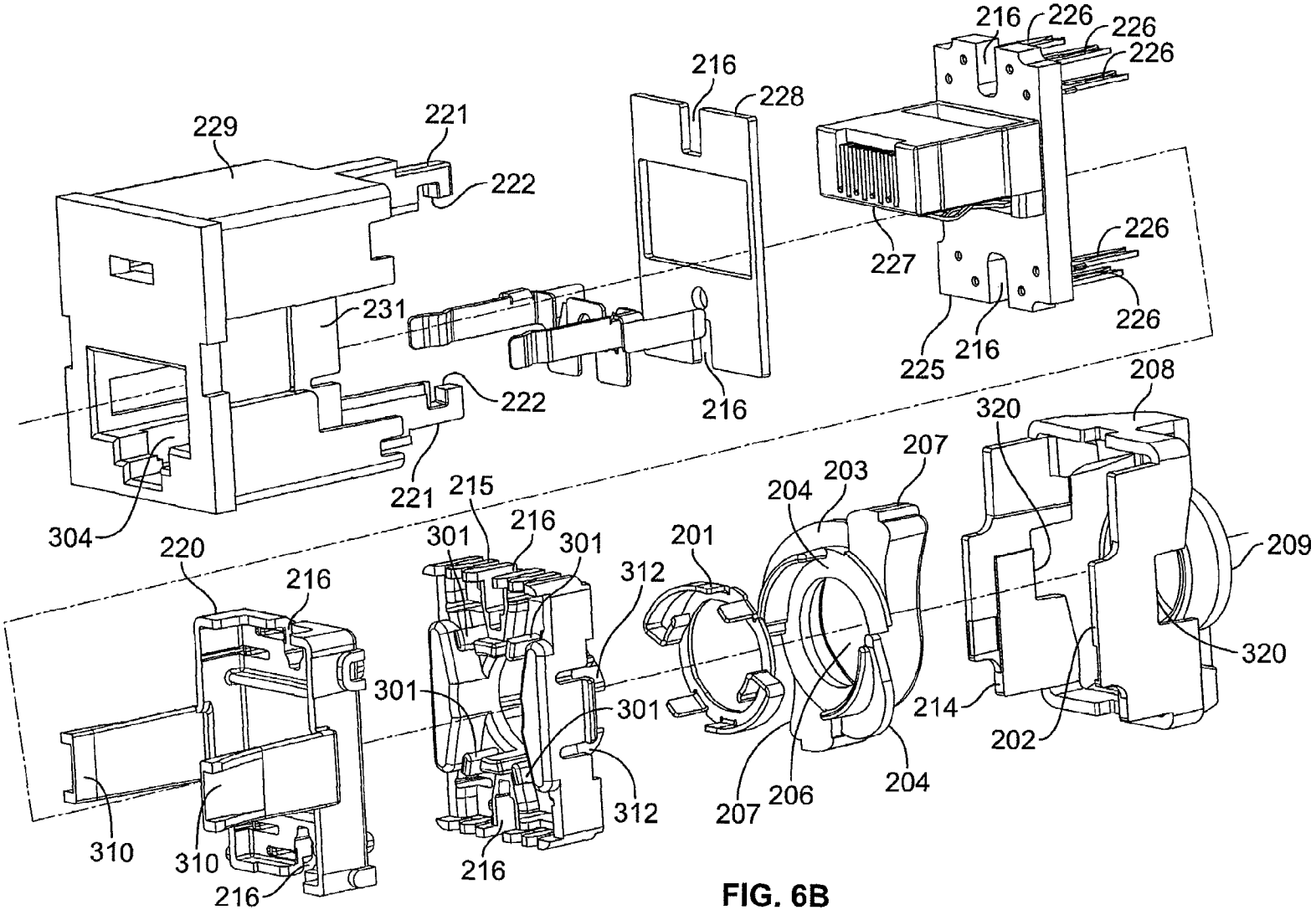
FIG. 6B is an exploded perspective view of the exemplary connector assembly of FIG. 6A viewed from the opposite direction as compared to the view of FIG. 6A.

Another exemplary embodiment according to the present disclosure is provided in FIGS. 6A and 6B. In reference to FIGS. 6A and 6B, an exemplary jack assembly according to another embodiment is indicated generally by reference numeral 200. Exemplary jack assembly 200 can provide a termination to an FTP cable or FTP wires and is substantially similar to the jack assembly shown in FIGS. 1 and 2 and described above, and therefore like reference numerals preceded by the numeral "2" or the numeral "3" (as opposed to the numeral "1"), are used to indicate like elements. The primary difference associated with exemplary jack assembly 200 as compared to the jack assemblies shown in FIGS. 1 and 2 involves (i) the location of the contact 201 and cam nut 203, and (ii) the fact that the jack housing 229 includes or defines the at least one cam member 221 and at least one cam slot 222 (as opposed to the first sub-assembly housing 225).

As shown in FIGS. 6A and 6B, exemplary jack housing 229 defines or includes at least one cam member 221 that includes at least one cam slot 222. The cam member(s) 221 are preferably long enough to pass through several components and/or sub-assemblies to secure the components and/or sub-assemblies to the jack housing 229. In fact, in the illustrated embodiment, the exemplary cam members 221 pass through corresponding cam openings 216 defined by the contact insert 228, PCB 225, first sub-assembly housing 220 and routing cap 215 for ultimate termination with cam nut 203. Therefore, since the deflectable contact 301 is coupled to the routing cap 215 (described below), the exemplary jack housing 229, contact insert 228, PCB 225, first sub-assembly housing 220, routing cap 215 and deflectable contact 301 can be coupled to one another by through the interaction of cam nut 203 and the at least one cam member 221.

As noted above, a difference between the exemplary jack assembly 200 as compared to the jack assembly shown in FIGS. 1 and 2 involves the locations of the contact 201 and cam nut 203. To accommodate a deflectable contact 201 located between the routing cap 215 and second sub-assembly housing 208, the face of the routing cap 215 opposite the wire channels 301 includes a contact engaging member 312. A shown best by FIG. 7, the deflectable contact 201 may include at least one deflectable finger or tab 314 which is designed to mate with the contact engaging member 312 of the routing cap 215 to thereby couple the two components. Further, the second sub-assembly housing 208 defines a width such that apertures can be formed behind the cylindrical member 209 (in respect to the outer surface of the second sub-assembly housing 208), in which the cam nut 203 may be housed and/or able to rotate within. In this manner, the deflectable contact 201 and the cam nut 208 may be provided at least between the routing cap 215 and the second sub-assembly housing 208.

It is noted that the cam nut 203 may or may not secure the second sub-assembly housing 208 to other components, such as the routing cap 215. For example, the cam nut 203 may be larger, given a certain dimension and angular position, as compared to the corresponding aperture formed by the second sub-assembly housing 208, and thus the cam nut 203 may prevent the second sub-assembly housing 208 from movement away from the routing cap 215 (when the cam nut 203 is engaged with the cam members 221). However, the cam nut 203 may be smaller, given a certain angular position, than the corresponding aperture formed by the second sub-assembly housing 208, and thus the second sub-assembly housing 208 may not be prevented by the cam nut 203 from being removed from, or placed over, cam nut 203 when cam nut 203 is secured to the routing cap 215 via the at least one cam thread 204 and at least one cam slot 222.

It is further noted that, as described above, the sub-components of exemplary jack assembly 200 may be coupled to one another to form sub-assemblies that may be assembled to form a finished or complete jack assembly. For example, the first sub-assembly housing 220 includes or defines tabs 310 which may mate with tabs or slots included in the jack assembly 229, such as tabs 231. As such, the jack assembly 229, contact insert 228, PCB 225, first sub-assembly housing 220 and combinations thereof may form a first connector sub-assembly. Similarly, the second sub-assembly housing 208 may include tabs or deflectable members 202, as well as gaps or slots 320, which may mate with, for example, taps or slots 312 of the routing cap 215. As such, the routing cap 215, contact 201, cam nut 203, second sub-assembly housing 208 and combinations thereof may form a second connector sub-assembly. Further, said first connector sub-assembly and second connector sub-assembly may be coupled to one another though the interaction of the cam nut 203 (and the cam threads 204 thereon) and the cam members 221 (and the cam slots 222 thereon).

Another difference between the exemplary jack assembly 200 as compared to the exemplary jack assembly shown in FIGS. 1 and 2 involves the design of the contact 201 and cam nut 203—to accommodate their positioning between at least the routing cap 215 and the second sub-assembly housing 208. As shown best by FIG. 7, the exemplary deflectable contact 201 is generally circular, although it need not be. The exemplary deflectable contact 201 includes deflectable tabs or fingers 314 which facilitate the coupling of the deflectable contact 201 to the contact member 312 of the routing cap 215. The exemplary deflectable contact 201 also includes at least one (shown with two) deflectable arms 316 which extend away from the generally circular circumference of the body of the deflectable contact 201 in a rest position. The arms 316 of exemplary deflectable contact 201 define a thickness such that when the outer surface of arms 316 is brought about even with the circumference of the body of the deflectable contact 201, the inner surface of the arms extends into the circumference of the body of the deflectable contact 201. In this way, when the contact 201 is located between the routing cap 215 and the cam nut 203 and in respect to the wire openings 206, in the rest position the arms 316 do not penetrate or otherwise interfere with the boundaries of the wire openings 206. However, in a deflected position (not shown), the arms 316 are swung or otherwise translated or deflected into the wire openings 206, and thus contact or engage, for example, and FTP wire carried therein.

Figure 7:
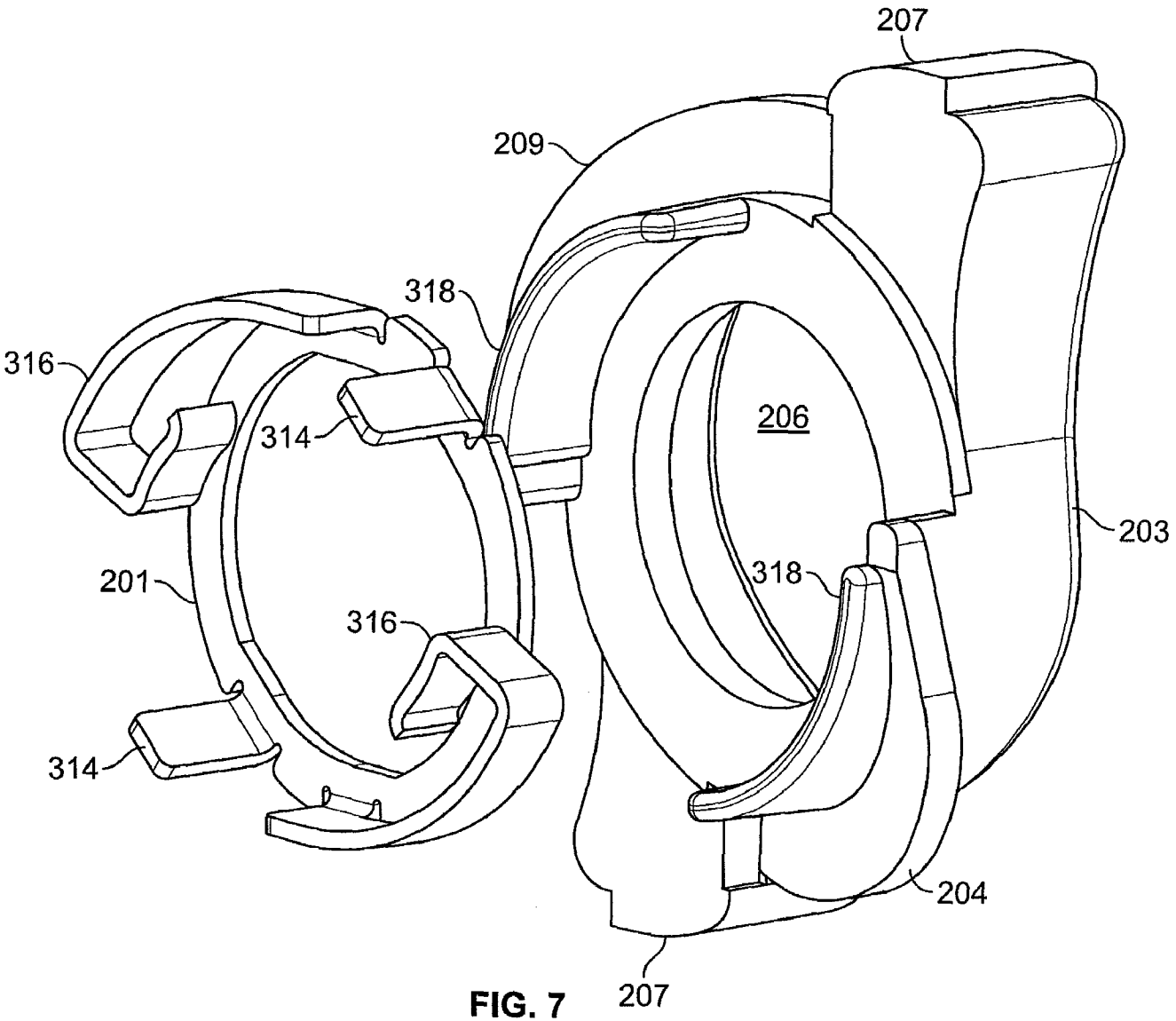
FIG. 7 is an exploded perspective view of the cam nut and deflectable contact of the exemplary connector assembly of FIGS. 6A and 6B.

As also shown best by FIG. 7, exemplary cam nut 203 may include deflecting members 318 that extend from the cam nut 203. The exemplary deflecting members 318 provide a raised surface that does not continue along the entire circumference of the deflectable contact 201. Thus, as cam nut 203 is rotated, the deflecting members 318 selectively contact and deflect the arms 316—the arms 316 remain in the rest position until the deflecting members 318 are rotated into a position such that they interact with the arms 316 and incrementally deflect the arms 316 inwardly (towards the center on the wire openings 206) as rotation progresses. In this way, the alignment and combination of the at least one thread 204 on the outside of the cam nut 203 (interacting with a cam slot 222) and the non-continuous deflecting members 318 provide for simultaneous deflection of the contact 201 and coupling of the components as the cam nut 203 is rotated.

As seen best in FIG. 6B, the exemplary cam nut 203 is seated or otherwise mounted on the cylindrical member 209 of the exemplary second sub-assembly housing 208. The cylindrical member 209 may ensure the cam nut 203 is substantially centered with respect to the wire openings 206 and substantially appropriately positioned with respect to the cam slot 222 and deflectable contact 201 (including the deflectable members 318 and corresponding deflectable arms 316).

The embodiments described above are only exemplary embodiments and it may be readily understood by those having skill in the pertinent art from the present disclosure that any of numerous changes and modifications may be made to the above-described and other embodiments of the present invention without departing from the scope of the invention as defined in the appended claims. Although the present disclosure discloses and describes exemplary connector assembly embodiments and associated assembly techniques, it is to be understood that the present disclosure is neither limited by or to such exemplary embodiments. Rather, the disclosed connector assembly embodiments and associated assembly techniques are merely illustrative. As such, various modifications, variations and/or enhancements to the disclosed connector assembly embodiments/techniques may be made without departing from the spirit or scope of the present disclosure.

For example, the components of the jack assembly may not utilize deflectable tabs and slots to couple to one another, but may be coupled by other means, such as screws, glues, gravity or simply press-fit. Similarly, the components of the jack assembly may not be coupled to one another besides by the cam member and cam nut. As another example, any of the components may include or define one or more (i.e., at least one) cam member and cam slot, such as the jack housing, first sub-assembly housing, routing cap, second sub-assembly housing or any other component included in the jack assembly. Similarly, any of the components may include one or more (i.e., at least one) cam openings that allow the cam member(s) to pass therethrough and, therefore, couple that component to any other components through the use of a cam nut and the cam member, such as the jack housing, first sub-assembly housing, routing cap, second sub-assembly housing or any other component included in the jack assembly. As another example, components may be removed, added or a combination thereof without departing from the scope of the invention. Similarly, the arrangement and/or order of components may be modified or otherwise altered, such as an arrangement wherein the contact or cam nut is located at least between the jack housing and the first sub-assembly housing, the first sub-assembly housing and the routing cap, the routing cap and the second sub-assembly housing, or located on the outside surface of the jack housing or on the outside surface of the second sub-assembly housing. As another example, the contact need not be deflectable, but instead or in addition to being deflectable may be moveable or otherwise capable of a first position wherein the contact in not in interference with an FTP cable/wire and a second position in which the contact is capable of interfering with an FTP cable/wire.

What is claimed is:

1. A connector assembly including a plurality of components, comprising:

a. a jack housing defining a plug opening and a first opening;

b. a first housing in proximity to the first opening;

c. a routing cap that defines at least one routing channel and a first opening sized and dimensioned to allow at least one wire pair to pass through said first opening;

d. a second housing including a cylindrical member defining a second opening sized and dimensioned to allow at least one wire pair to pass through said second opening;

e. a cam nut defining at least one cam thread mounted with respect to said cylindrical member; and f. a deflectable contact, wherein at least one of the jack housing, first housing and routing cap define at least one cam member that defines a cam slot, and at least one of the first housing, routing cap and second housing define a cam opening sized and dimensioned to allow said cam member to pass through said cam opening, and wherein said at least one cam thread is configured and dimensioned to interact with said cam slot such that rotation of the cam nut and said at least one cam thread securely couple at least two components to one another and deflects said deflectable contact.

2. A connector assembly according to claim 1, wherein the cam nut further includes at least one cam stop member.

3. A connector assembly according to claim 1, wherein the connector assembly is shielded.

4. A connector assembly according to claim 1, wherein the second housing defines a first outer surface and a second surface substantially opposite said first surface.

5. A connector assembly according to claim 4, wherein the second surface of the second housing is proximate the routing cap.

6. A connector assembly according to claim 5, wherein the cam nut is mounted with respect to the cylindrical member such that the cam nut is proximate the first outer surface of the second housing.

7. A connector assembly according to claim 6, wherein the cylindrical member includes one or more fingers or deflectable latching members.

8. A connector assembly according to claim 7, wherein the contact is detachably coupled to the cylindrical member of the second housing by the one or more fingers or deflectable latching members.

9. A connector assembly according to claim 8, wherein the inner diameter of the cam nut and outer diameter of the cylindrical member are sized and shaped to allow the cam nut to deflect said one or more fingers or deflectable latching members inward and thereby deflect said contact inward.

10. A connector assembly according to claim 9, wherein the first housing defines at least one cam and cam slot, and wherein rotation of the cam nut and the at least one cam thread securely couple at least the first housing, routing cap and second housing.

11. A connector assembly according to claim 10, wherein rotation of the cam nut further results in deflection of said contact inward.

12. A connector assembly according to claim 11, wherein said inward deflection of the contact causes said contact to engage at least one of an FTP cable, drain wire and wire foil or sheath.

13. A connector assembly according to claim 4, wherein the cam nut is mounted with respect to the cylindrical member such that the cam nut is proximate the second surface of the second housing.

14. A connector assembly according to claim 13, wherein the contact is mounted with respect to the routing cap with respect to the first opening, and wherein the contact is proximate the cam nut.

15. A connector assembly according to claim 14, wherein the cam nut is sized and shaped to allow the cam nut to deflect said contact inward.

16. A connector assembly according to claim 15, wherein the jack housing defines at least one cam member and cam slot, and wherein rotation of the cam nut and cam threads securely couple the jack housing, first housing, routing cap and second housing.

17. A connector assembly according to claim 16, wherein rotation of the cam nut also deflects said contact inward.

18. A connector assembly according to claim 17, wherein said inward deflection of the contact causes said contact to engage at least one of an FTP cable, drain wire and wire foil or sheath.

19. A connector assembly according to claim 1, further comprising a printed circuit board, wherein said printed circuit board includes plug connection elements and terminals and is located between at least the jack housing and the first housing, and wherein at least one plug connection element aligns with the plug opening of the jack housing.

20. A connector assembly according to claim 19, further comprising a contact insert located between the at least the jack housing and the printed circuit board.

21. A connector assembly, comprising:

a. a jack housing defining a plug opening and a first opening, wherein said jack housing includes at least one cam member that includes at least one cam slot;

b. a first connector sub-assembly housing detachably coupled to said jack housing proximate the first opening, and defining at least one first cam opening sized and dimensioned to allow said at least one cam member to pass through said at least one first cam opening;

c. a routing cap that defines at least one routing channel, a first wire opening sized and dimensioned to allow at least one wire pair to pass through said opening and enter said at least one routing channel, and at least one second cam opening sized and dimensioned to allow said at least one cam member to pass through said at least one second cam opening;

d. a deflectable contact coupled with respect to the routing cap in proximity to the first wire opening of the routing cap;

e. a second sub-assembly housing detachably coupled to said routing cap, wherein said second sub-assembly housing includes a cylindrical member and a second wire opening sized and dimensioned to allow at least one wire pair to pass through said opening; and f. a cam nut defining a third wire opening sized and dimensioned to allow at least one wire pair to pass through said opening and mounted with respect to said deflectable contact and said cylindrical member, wherein said cam nut includes at least one cam thread configured and dimensioned to interact with said at least one cam slot.

22. A connector assembly according to claim 21, wherein the plug opening and the first opening are oppositely directed.

23. A connector assembly according to claim 21, wherein the contact includes a conductive material.

24. A connector assembly according to claim 21, wherein the connector assembly is shielded.

25. A connector assembly according to claim 21, wherein the cam nut further includes at least one cam stop member.

26. A connector assembly according to claim 21, wherein the contact includes at least one deflectable arm.

27. A connector assembly according to claim 26, wherein the cam nut is sized and shaped such that rotation of the cam nut deflects said at least one deflectable arm towards at least one of said first, second and third wire openings.

28. A connector assembly according to claim 27, wherein the contact engages at least one of an FTP cable, drain wire and wire foil or sheath when said contact is deflected.

29. A connector assembly according to claim 21, wherein the contact includes one or more fingers or deflectable latching members.

30. A connector assembly according to claim 29, wherein the contact is coupled to the routing cap by the one or more fingers or deflectable latching members.

31. A connector assembly according to claim 21, wherein rotation of the cam nut and the at least one cam thread securely couple at least the jack housing, first connector sub-assembly housing, routing cap and contact.

32. A connector assembly according to claim 31, wherein rotation of the cam nut also deflects the contact into engagement with at least one of an FTP cable, drain wire and wire foil or sheath.

33. A connector assembly according to claim 21, further comprising a printed circuit board, wherein said printed circuit board includes plug connection elements and terminals held between at least the jack housing and the first connector sub-assembly housing, and wherein at least one plug connection element aligns with the plug opening of the jack housing.

34. A connector assembly according to claim 33, further comprising a contact insert held between at least the jack housing and the printed circuit board.

35. A connector sub-assembly for interaction with at least one connector component including at least one cam member that includes at least one cam slot, comprising:

a. a routing cap that defines at least one routing channel, a first wire opening sized and dimensioned to allow at least one wire pair to pass through said opening and enter said at least one routing channel, and at least one first cam opening sized and dimensioned to allow said at least one cam member to pass through said at least one first cam opening;

b. a deflectable contact coupled with respect to the routing cap in proximity to the first wire opening of the routing cap; and c. a second sub-assembly housing detachably coupled to said routing cap, wherein said second sub-assembly housing includes a cylindrical member and a second wire opening sized and dimensioned to allow at least one wire pair to pass through said opening; and d. a cam nut defining a third wire opening sized and dimensioned to allow at least one wire pair to pass through said opening, wherein the cam nut is mounted with respect to said deflectable contact and said cylindrical member, and wherein said cam nut includes at least one cam thread configured and dimensioned to interact with at least one cam slot of at least one cam member.

36. A connector sub-assembly according to claim 35, wherein rotation of the cam nut and the at least one cam thread deflects said contact inward.

37. A connector sub-assembly according to claim 36, wherein said inward deflection of the contact causes said contact to engage at least one of an FTP cable, drain wire or wire foil or sheath.

38. A connector assembly, comprising:

a. a first connector sub-assembly including at least:

i. a jack housing defining a plug opening and a first opening, wherein said jack housing includes at least one cam member that includes at least one cam slot;

ii. a first connector sub-assembly housing detachably coupled to said jack housing proximate the first opening, and defining at least one first cam opening sized and dimensioned to allow said at least one cam member to pass through said at least one first cam opening;

iii. a printed circuit board that includes a plurality of plug connection elements and terminals held between at least the jack housing and the first connector sub-assembly housing, and wherein at least one of said plurality of plug connection elements aligns with the plug opening of the jack housing; and iv. a contact insert held between at least the jack housing and the printed circuit board, and b. a second connector sub-assembly including:

i. a routing cap that defines at least one routing channel, a first wire opening sized and dimensioned to allow at least one wire pair to pass through said opening and enter said at least one routing channel, and at least one first cam opening sized and dimensioned to allow said at least one cam member to pass through said at least one first cam opening;

ii. a deflectable contact coupled with respect to the routing cap in proximity to the first wire opening of the routing cap; and iii. a second sub-assembly housing detachably coupled to said routing cap, wherein said second sub-assembly housing includes a cylindrical member and a second wire opening sized and dimensioned to allow at least one wire pair to pass through said opening; and iv. a cam nut defining a third wire opening sized and dimensioned to allow at least one wire pair to pass through said opening, wherein the cam nut is mounted with respect to said deflectable contact and said cylindrical member, and wherein said cam nut includes at least one cam thread configured and dimensioned to interact with the at least one cam slot of the at least one cam member, wherein said first connector sub-assembly is coupled to said second connector sub-assembly and said deflectable contact is deflected from a first position to a second position that is located closer towards at least one of the first, second and third wire openings as compared to the first position.

39. A connector assembly according to claim 38, wherein said first connector sub-assembly is coupled to said second connector sub-assembly by the rotation of the cam nut.

40. A connector assembly according to claim 39, wherein said rotation of the cam nut rotates the at least one cam thread causing said cam thread to interact with the at least one cam slot.

41. A connector assembly according to claim 40, wherein said deflection of the contact is caused by rotation of the cam nut.

42. A connector assembly according to claim 38, wherein said inward deflection of the contact causes said contact to engage at least one of an FTP cable, drain wire and wire foil or sheath.

43. In combination:

a. a jack housing defining a plug opening and a first opening, wherein said jack housing includes at least one cam member that includes at least one cam slot;

b. a first connector sub-assembly housing detachably coupled to said jack housing proximate the first opening, and defining at least one first cam opening sized and dimensioned to allow said at least one cam member to pass through said at least one first cam opening;

c. a routing cap that defines at least one routing channel, a first wire opening sized and dimensioned to allow at least one wire pair to pass through said opening and enter said at least one routing channel, and at least one second cam opening sized and dimensioned to allow said at least one cam member to pass through said at least one second cam opening;

d. a deflectable contact coupled with respect to the routing cap in proximity to the first wire opening of the routing cap;

e. a second sub-assembly housing detachably coupled to said routing cap, wherein said second sub-assembly housing includes a cylindrical member and a second wire opening sized and dimensioned to allow at least one wire pair to pass through said opening; and f. a cam nut defining a third wire opening sized and dimensioned to allow at least one wire pair to pass through said opening and mounted with respect to said deflectable contact and said cylindrical member, wherein said cam nut includes at least one cam thread configured and dimensioned to interact with said at least one cam slot.

44. The combination according to claim 43, wherein rotation of the cam nut and the at least one cam thread couple at least the jack housing, first connector sub-assembly housing, routing cap and said contact.

45. The combination according to claim 44, wherein rotation of the cam nut further results in deflection of said contact inward towards at least one of the first, second and third openings.

46. The combination according to claim 45, wherein said inward deflection of the contact causes said contact to engage at least one of an FTP cable, drain wire and wire foil or sheath.

47. In combination:

a. a routing cap that defines at least one routing channel, a first wire opening sized and dimensioned to allow at least one wire pair to pass through said opening and enter said at least one routing channel, and at least one first cam opening sized and dimensioned to allow a cam member to pass through said at least one first cam opening;

b. a deflectable contact coupled with respect to the routing cap in proximity to the first wire opening of the routing cap; and c. a second sub-assembly housing detachably coupled to said routing cap, wherein said second sub-assembly housing includes a cylindrical member and a second wire opening sized and dimensioned to allow at least one wire pair to pass through said opening; and d. a cam nut defining a third wire opening sized and dimensioned to allow at least one wire pair to pass through said opening, wherein the cam nut is mounted with respect to said deflectable contact and said cylindrical member, and wherein said cam nut includes at least one cam thread configured and dimensioned to interact with at least one cam slot of at least one cam member.

48. The combination according to claim 47, wherein rotation of the cam nut and the at least one cam thread results in deflection of said contact inward.

49. The combination according to claim 48, wherein said inward deflection of the contact causes said contact to engage at least one of an FTP cable, drain wire or wire foil or sheath.

50. A method for effecting a foil-shielded twisted pair (FTP) cable termination, the method comprising:

a. providing a connector assembly including:

i. a jack housing defining a plug opening and a first opening, wherein said jack housing includes at least one cam member that includes at least one cam slot;

ii. a first connector sub-assembly housing detachably coupled to said jack housing proximate the first opening, and defining at least one first cam opening sized and dimensioned to allow said at least one cam member to pass through said at least one first cam opening;

iii. a routing cap that defines at least one routing channel, a first wire opening sized and dimensioned to allow at least one wire pair to pass through said opening and enter said at least one routing channel, and at least one second cam opening sized and dimensioned to allow said at least one cam member to pass through said at least one second cam opening;

iv. a deflectable contact coupled with respect to the routing cap in proximity to the first wire opening of the routing cap;

v. a second sub-assembly housing detachably coupled to said routing cap, wherein said second sub-assembly housing includes a cylindrical member and a second wire opening sized and dimensioned to allow at least one wire pair to pass through said opening; and vi. a cam nut defining a third wire opening sized and dimensioned to allow at least one wire pair to pass through said opening and mounted with respect to said deflectable contact and said cylindrical member, wherein said cam nut includes at least one cam thread configured and dimensioned to interact with said at least one cam slot, and b. connecting an FTP cable to the connector assembly including:

i. inserting an end of the FTP cable including at least one of a drain wire, metal foil and sheath through the first, second and third wire openings; and ii. rotating said cam member to thereby couple at least the jack housing, first connector sub-assembly, routing cap and deflectable contact, and deflect said deflectable contact into engagement with at least one of the drain wire, metal foil and sheath.

* * * * *